United States Patent [19]

Brown et al.

[11] Patent Number: 4,580,188

[45] Date of Patent: Apr. 1, 1986

[54] METHODS OF AND APPARATUS FOR PROTECTING CIRCUIT ELEMENTS FROM ELECTROSTATIC DISCHARGES

[75] Inventors: David F. Brown, Bethlehem; Joseph L. Jones, Jim Thorpe; Livio R. Melatti; David C. Sullivan, both of Bethlehem; George F. Wilkinson, Jr., Northampton, all of Pa.

[73] Assignee: AT&T Technologies, Inc., Berkeley Heights, N.J.

[21] Appl. No.: 656,118

[22] Filed: Sep. 28, 1984

[51] Int. Cl.[4] ..... H05F 3/02

[52] U.S. Cl. ..... 361/212; 324/51; 324/63; 324/133; 361/220

[58] Field of Search ..... 361/212, 220; 340/649, 340/652, 661; 324/51, 63, 64, 133

[56] References Cited

U.S. PATENT DOCUMENTS

| | | | |
|---|---|---|---|
| 3,848,185 | 11/1974 | Hentschel | 324/63 X |
| 3,963,981 | 6/1976 | Vis | 324/51 |
| 4,366,434 | 12/1982 | Ellis | 324/51 |
| 4,373,175 | 2/1983 | Mykkanen | 361/220 |

OTHER PUBLICATIONS

J. R. Huntsman et al., "Test Methods for Static Control Products," Electrical Overstress/Electrostatic Discharge Symposium Proceedings, Orlando, FL, Sep., 1982.

ESD Product Description, *Evaluation Engineering*, Oct., 1983, p. 82, last paragraph.

ESD Products, "Resistance Interval Meter Tests Wrist Straps," *Evaluation Engineering*, Oct., 1983, p. 88.

Application Note, *Electronics Test*, Mar. 1984, p. 148.

*Primary Examiner*—Harry E. Moose, Jr.

*Attorney, Agent, or Firm*—W. O. Schellin

[57] ABSTRACT

The continuity of a ground strap (16) is tested by pushing down on a switch activating toggle lever (37). The toggle lever is conductive, is isolated from ground and is coupled to a signal input terminal of a test circuit module (14). Thus, when the hand of the operator touches the toggle lever to activate the test circuit module (14), the resistive path through the operator and the ground strap (16) is coupled into the test circuit as the input-terminal-to-ground resistor of a voltage divider circuit. A resulting voltage at the toggle lever causes an indication by lighting either indicator (33) or indicator (34) whether the operator is properly coupled to ground.

10 Claims, 3 Drawing Figures

METHODS OF AND APPARATUS FOR PROTECTING CIRCUIT ELEMENTS FROM ELECTROSTATIC DISCHARGES

TECHNICAL FIELD

This invention relates to methods of and apparatus for protecting circuit elements, such as MOS semiconductor devices, from becoming subjected to electrostatic discharges while being handled during assembly operations. The invention relates to methods of protecting the circuit elements by identifying whether ground straps which are intended to dissipate electrostatic energy are functional. The invention relates furthermore to apparatus for identifying improperly connected ground straps which could prevent accumulating electrostatic energy from dissipating.

BACKGROUND OF THE INVENTION

Semiconductor devices, such as MOS integrated circuits, are easily destroyed by electrostatic discharges. Damaging electrostatic discharges are likely to occur during any of various assembly operations which involve handling the devices. Particularly when the devices are handled as individual units and are not coupled into a grounded circuit, they are likely to inadvertently become a link in an electrostatic discharge path. It is typically during handling operations relating to testing, sorting, inspecting and mounting the devices on circuit substrates that electrostatic energy which unsuspectedly may have accumulated on an operator becomes released through a device to destroy some circuit element in the device. Procedures are implemented at semiconductor device production and assembly facilities to minimize the occurrences of damaging electrostatic discharges. Among these procedures is the wearing of ground straps. Ground straps are attached to electrically conductive, elastic wrist bands worn by assembly workers to couple the workers electrically to a chassis ground, such as a grounded workbench. The connections to the grounded benches are made, for example, by clipping the ends of the ground straps to the benches or by plugging the ends into grounded sockets. Thus, as the assembly workers move about at the assembly benches to perform their operations, electrostatic charges are continually dissipated through the ground straps as they are generated by the workers' movements.

Problems which do occur on a not so infrequent basis are related to the ground straps failing to establish an electrically continuous path from the workers to ground and, because of the inherent passiveness of a well-established ground connection, such a failure going unnoticed until after damage is already done to semiconductor devices. The problem is compounded by some types of semiconductor devices being so sensitive to electrostatic energy that a typical electrostatic discharge sufficiently severe to destroy a device need not be so severe as to be noticeable to the worker who causes the electrostatic discharge.

An electrically open ground strap connection may occur, for example, when a worker first attempts to couple the ground strap to a bench. Unnoticed intervening dielectric substances, such as intervening dielectric particles or, generally, any smudged contact can prevent a functional ground connection from becoming established. Also, the elastic wrist bands may slip over pieces of clothing or may otherwise fail to establish electrically sufficient contact with the skin to cause the ground strap to fail in dissipating on a continual basis any accumulating electrostatic charges.

SUMMARY OF THE INVENTION

The present invention overcomes problems which have been experienced with state-of-the-art ground straps and means for testing their continuity. In particular, the invention includes improved testing the ground straps to ascertain their continuity and proper function before devices are handled which could be destroyed by electrostatic discharges. In accordance with the invention, the methods of and apparatus include establishing a test signal input by dividing a supply voltage through a high-ohmic voltage divider circuit wherein the input-to-ground voltage is measured across the ground strap worn by the worker and the supply-to-input voltage is established by a safety impedance which exceeds the value for a known safety resistance included in series in the ground strap. In one embodiment in accordance with the invention, the test path is established through a manual activation of a normally open switch which activates a test circuit and couples the operator through the switch actuator to the test circuit during the activation of the switch.

BRIEF DESCRIPTION OF THE DRAWING

Various features and advantages of the invention will be best understood when the following detailed description is read in reference to the appended drawing, wherein.

DETAILED DESCRIPTION

The Protection Features In General

Figure 1:
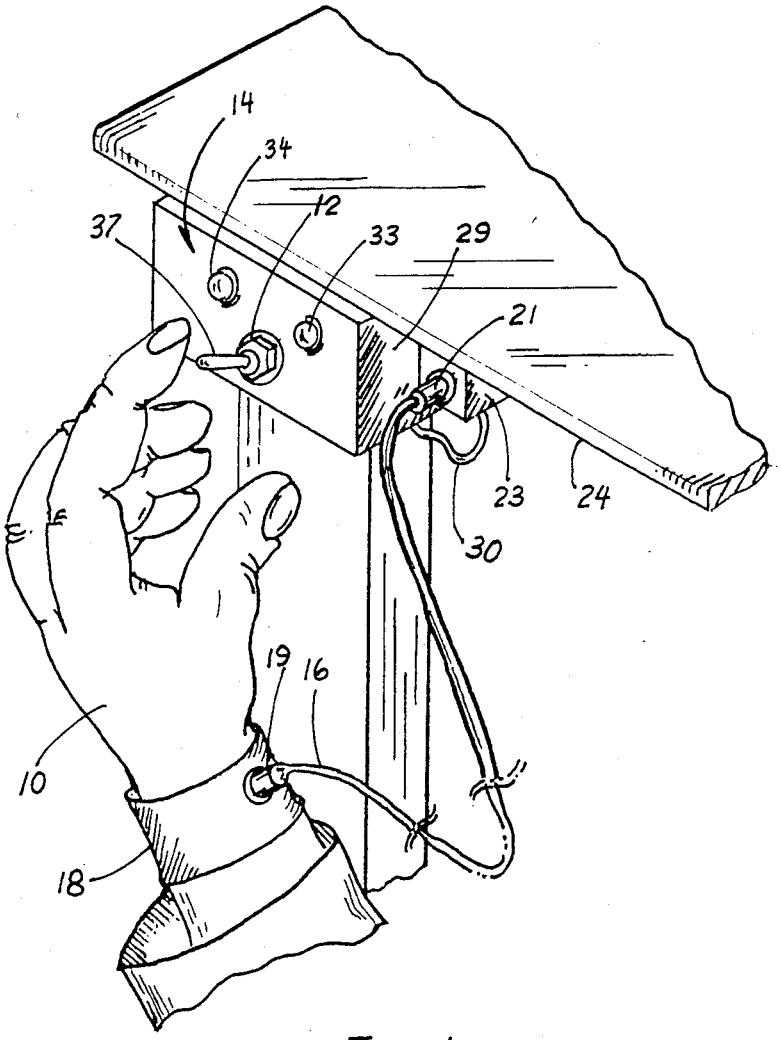
FIG. 1 is a pictorial representation of a portion of a typical workbench to which is mounted a test circuit module as a preferred embodiment of the invention, such module being about to become activated to test the integrity of a ground strap connection worn by an operator.

FIG. 1 shows an operator's hand 10 reaching for a switch 12 of a test module 14 for ascertaining the integrity of a ground strap 16 worn by the operator. The ground strap 16 typically is a flexible, stranded electrical conductor which is coupled between the operator and ground. As shown in FIG. 1, the ground strap 16 is attached to the operator through an electrically conductive, elastic wrist band 18 worn by the operator. A snap connector 19, for example, attaches the ground strap 16 to the wrist band 18, and a male plug connector 21 establishes a grounded connection at a grounded receptacle 23 mounted to a typical workbench 24. The workbench is preferred to have a metal frame which is directly coupled to a chassis gound, such that the mounting of the receptacle 23 to the workbench 24 establishes an electrically continuous connection between the ground strap 16 and ground. However, if the workbench is of a wooden construction or is otherwise not properly grounded, the receptacle 23 must be electrically connected directly to a chassis ground such as a grounded conduit pipe or the like.

After connecting one end of the ground strap 16 to the wrist band 18 and plugging the other end into the grounded receptacle 23, an operator ascertains in accordance with a preferred procedure whether the ground strap 16 indeed is properly connected to ground and is therefore capable of providing the desired protection.

The test module 14 shown in FIG. 1 is capable of testing whether the ground strap 16 has the desired integrity or whether an inadvertent discontinuity in the strap itself or in any of the coupling connections to ground prevents the operator from remaining at an electrical ground level while moving about and handling devices. The test module 14 is preferably housed in an electrically conductive housing 29 which is coupled directly to ground. Typically the workbench 24 is a metal bench which is grounded directly to a grounded pipe or any other stable ground potential often referred to as "chassis ground". The housing 29 is mounted to the workbench in a manner which electrically couples the housing to the established chassis ground, such as by electrically conductive mounting screws or other direct grounding connections 30.

Other than by the respective connections to a common ground, no other permanent electrical connections are preferred to exist on a permanent basis between the operator and the test module 14. The preferred embodiment described herein takes into consideration an operator's natural reluctance to be coupled for a prolonged period to an electrical apparatus. However, for testing the integrity and continuity of all connections between the operator's hand 10 and the receptacle 23, electrical continuity between the operator and the test module 14 are established, at least temporarily, to indicate by the lighting of either a green or a red indicator 33 or 34, respectively, whether the ground strap 16 is properly connected, or whether the resistance of the ground strap falls outside of predetermined limits. Thus, when the operator's hand 10 pushes down on a normally upward spring-biased toggle lever 37 of the switch 12, two electrical functions become implemented. A first and certainly logical function is that of the normally open switch 12 toggling into a closed position to activate the test module 14. However, the operator by activating the test module 14 in the described manner, also becomes coupled into a test circuit with the module 14 through contact of the hand 10 with the toggle lever 37. While an operator needs to knowingly couple the ground strap path to ground into the test circuit, a natural reluctance to establish an electrical contact with one's body is minimized by allowing such contact to be made through an already known and quite familiar operation such as turning on an electrical switch.

Figure 2:
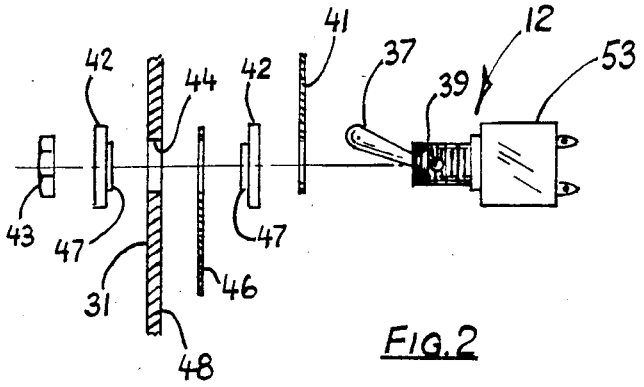
FIG. 2 is an expanded view of the mounting of a switch assembly of the test circuit module of FIG. 1, showing particular features of the preferred embodiment of the invention.

The manner by which the switch 12 temporarily couples the electrical connections between the operator and the chassis ground into the test circuit is best explained in reference to the mounting arrangement of the switch 12 shown in FIG. 2. The toggle lever 37 of the switch 12 is of metal and is, hence, electrically conductive. The toggle lever 37 is pivotally mounted within a conductive, threaded, cylindrical mounting stem 39 of the switch 12. An electrical terminal lug 41 is assembled over the mounting stem 39 before the switch becomes mounted to the faceplate 31. However, as mounted, the mounting stem 39 remains electrically isolated by two shouldered insulator spacers 42, which electrically space the lug 41, the stem 39 and a mounting nut 43 from any conducting contact with the faceplate 31 as the mounting stem 39 is inserted through an aperture 44 in the faceplate 31. A ground lug 46 is placed over a necked portion 47 of the inner one of the spacers 42. Thus, when the nut 43 becomes tightened over the threaded mounting tube 39, the ground lug 46 is forced into physical and electrical contact with an inner surface 48 of the faceplate. When the switch 12 is assembled to the faceplate 31 as described, the toggle lever 37 remains electrically isolated from the faceplate 31 as well as from electrical transfer elements of the switch 12 which are housed in an insulating switch housing 53.

The Test Circuit

Figure 3:
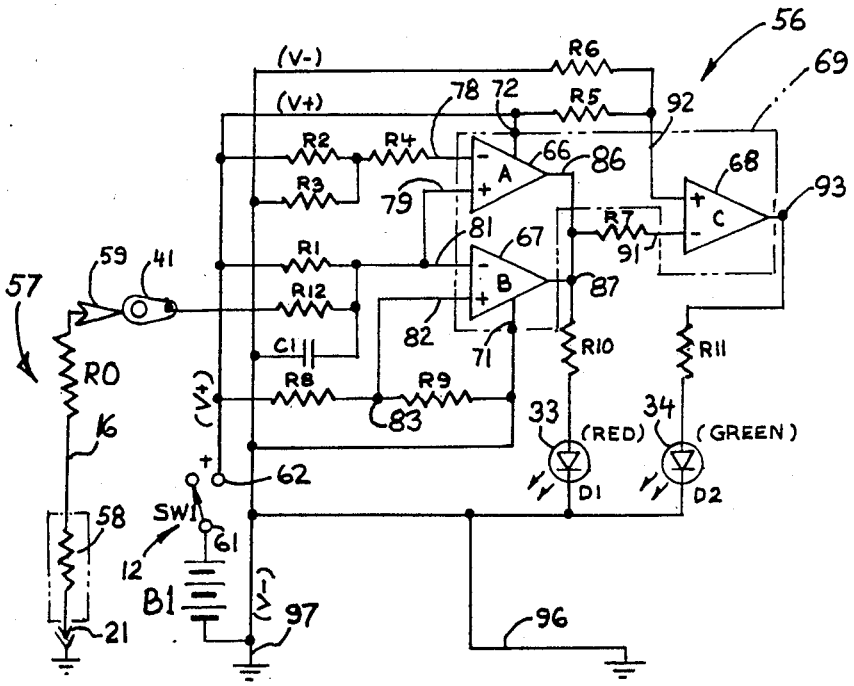
FIG. 3 is a diagram of a test circuit of the preferred embodiment of the invention shown in FIG. 1.

FIG. 3 is a schematic representation of an electrical circuit 56 for testing the integrity of various electrical connections between an operator and electrical ground which are associated with the ground strap 16. In the schematic of FIG. 3, the electrical path to be tested is designated generally by the numeral 57.

The skin resistance of an operator is indicated by a resistor RO. The skin resistance of an operator has been found to vary widely, depending apparently on various known and unknown factors such as the number of contact points which establish electrical contact, the presence and acidity of skin moisture and even the texture of skin tissue at the point of contact with electrical contact elements. For purposes of two skin-resistive contacts coupled in series between the preferred test circuit and ground, a range of resistance values between a negligible skin resistance on the low end of the range and a value of about 8 M ohms ($8\times10^6$ ohms) at the high end of the range is taken into consideration.

In considering that an operator could possibly have a negligible skin resistance between the wrist band 18 (worn as shown in FIG. 1) and the wrist, a potential safety hazard is recognized in the use of ground straps as they are presently known and used in the electronics industry. While a ground strap shields an operator using the ground strap from most annoying sudden shocks due to electrostatic discharges, the ground straps conceivably raise the risk of placing the operator into a potentially hazardous current path should the operator inadvertently come into contact with a line voltage powered terminal. Consequently, as shown in the schematic representation in FIG. 3, the ground strap 16 has a current limiting safety resistor 58 connected in series between the strap 16 and the male connector plug 21. In the preferred embodiment the plug 21 houses the resistor 58. A preferred value of the resistor 58 is 1 M ohms ($10^6$ ohms) which is found to be sufficiently small to drain accumulating electrostatic charges as they are being generated and yet have a sufficiently high value to substantially eliminate the ground strap as a current-caused shock hazard.

Referring to FIG. 3 with brief references to FIGS. 2 and 1, the isolated mounting of the switch 12 as described in reference to FIG. 2 establishes continuity between the toggle lever 37 and the isolated input lug 41. Thus, as the operator's hand 10 pushes down on the toggle lever 37 as it is about to take place in the illustration of FIG. 1, the operator's action establishes electrical continuity between the ground strap 16 and the input lug 41 as indicated by arrow 59 in FIG. 3. The operator's action also activates an electrical toggle SW1 of the switch 12 to electrically couple a positive terminal of a battery B1 through a common terminal 61 to a normally open terminal 62 of the switch 12 and to thereby supply a positive voltage to the test circuit 56.

In the described embodiment, the battery B1 is a typical 9 volt rectangular battery.

Three differential amplifier circuit elements 66, 67 and 68 are standard, commercially available elements such as a four-amplifier LM324 Operational Amplifier integrated circuit package 69 manufactured by National Semiconductor. Only a single positive supply voltage connection 71 and a single ground connection 72 are shown as representative connections even though each of the amplifier circuit elements 66, 67 and 68 of the package is coupled to both the positive voltage and to ground.

The function of the test circuit 56 is to warn the operator of an improper connection or of a potentially hazardous low-ohmic condition in the ground strap 16. In the described circuit, the red and green indicators 33 and 34 are, respectively, a red light emitting diode ("LED") for indicating such faulty connection or condition and a green LED for indicating that the ground strap 16 is properly connected and that the safety resistor 58 is not shorted out.

Upper and lower resistance limits for the connection of the ground strap 16 are tested by comparing voltages through predetermined resistances with voltages across the path 57 as input signals to the amplifier elements 66 and 67, respectively. The following description of the function of various components of the circuit 56 lists parenthetically preferred values for the components. It should, however, be understood that within the spirit and scope of the invention, various changes in the values of the components and even in the arrangement of the components are possible. The values are recited as an example and not to limit the scope of the invention.

A negative signal input terminal 78 to the amplifier element 66 is coupled to a fixed reference voltage established by voltage divider resistors R2 (47 K ohms) and R3 (150 K ohms) through an input buffer resistor R4 (10 M ohms). The buffer resistor R4 was found desirable to raise the input impedance at the input terminal 78 to the order of magnitude of the impedance which might be coupled to a positive input terminal 79 through the path 57 under test. The path 57 forms the test-voltage-to-ground portion of a divider circuit which provides a test input signal to both comparator amplifier elements 66 and 67. The signal voltage is determined by the proportional resistances of a fixed resistance R1 (2 M ohms) coupled to the positive supply voltage (V+) and the resistance of the path 57 under test including the ground strap 16 coupled through a bias resistor R12 (47 K ohms) to the terminal 79 for testing the upper resistance limit in the strap 16. The resistance of the resistor R1 is desirably of a magnitude which appreciably limits a current flowing from the battery B1 through the path 57 to ground. The path 57 under test is also coupled through the bias resistor R12 to a negative signal input terminal 81 of the amplifier element 67 for testing the lower resistance limit of the ground strap 16. A reference voltage at a positive signal input terminal 82 is determined by a reference mode 83 of a voltage divider circuit formed by the resistors R8 (47 K ohms) and R9 (18 K ohms) which are coupled in series between the positive supply voltage (V+) and ground (V−).

If the total resistance of the ground strap 16 including, of course, the resistive connections through the operator's skin to the wrist band 18 and the toggle lever 37 (See FIG. 1) exceeds approximately 9 M ohms ($9\times10^6$ ohms), an output terminal 86 of the amplifier element 66 in FIG. 3 generates a positive output signal and the red LED 33 lights up. Various tests have indicated that the skin resistances of most operators when measured through the wrist strap and through an additional skin contact remain below the value of 9 M ohms. The value of 9 M ohms has consequently been chosen as an upper limit of acceptable resistance values for the ground strap connection. The lower limit of acceptable resistance values is chosen to change an output signal at an output terminal 87 of the amplifier element 67 to a high to thereby turn on the red LED 33 in response to the resistance between the isolated input lug 41 and the ground potential falling below approximately 0.8 M ohms.

As long as the ground strap resistance has a value in a range between the chosen upper and lower limit values, neither one of the amplifier elements 67 and 68 will have a positive output signal, so that the voltage at a negative signal input terminal 91 of the amplifier element 68 is low with respect to the voltage at a positive signal input terminal 92, as established by a voltage divider circuit through resistors R5 (100 K ohms) and R6 (10 K ohms). An output signal from an output signal terminal 93, consequently, remains positive to light up the green LED 34.

A capacitor C1 (0.047 microfarads) is coupled between the input terminals 79 and 81 of the amplifier elements 66 and 67 and the ground potential to filter out sporadic, switched indications due to threshold noise when the resistances of the ground strap 16 are near one or the other of the limit values. The capacitor C1 also causes a visually different effect to be generated by the LEDs when the upper limit of acceptable resistance values is exceeded than when the lower resistance limit is transgressed. When the resistance in the ground strap 16 exceeds the upper limit, the capacitor C1 becomes charged with respect to ground through, for example, the resistor R1 until the voltage at the terminal 79 exceeds the voltage at the reference terminal 78. As a result, an indication that the upper resistance limit is exceeded is indicated by a brief signal (the duration of which is determined by the RC time constant of the resistor R1 and the capacitor C1) emitted from the green LED 34 which then changes to a steady signal from the red LED 33. When, in contrast, the low limit is transgressed, the red LED lights up as soon as the switch 12 is activated.

A ground connection is provided through a ground wire 96 in addition to a ground connection 97 which is typically established by mounting the test circuit module 14 to the grounded workbench 24. The additional wired connection 96 provides redundancy to assure the grounding of the module 14 to a chassis ground.

Various changes and modification are possible in the described preferred structural embodiment and in the methods of providing protection from electrostatic discharges without departing from the scope of the invention.

What is claimed is:

1. A method of protecting circuit elements from electrostatic discharges between an operator and ground, comprising:

coupling a ground strap between the operator and ground;

establishing electrical contact between the operator and a non-grounded signal input terminal of a voltage comparator circuit;

while the electrical contact between the operator and the signal input terminal remains established, applying a positive supply voltage to a positive power input terminal of the voltage comparator circuit and to a positive terminal of a safety impedance coupled with its other terminal to the non-grounded signal input terminal, whereby a voltage at the input signal terminal becomes dependent on the resistive path of the ground strap between the operator and ground; and comparing the voltage at the signal input terminal to at least one predetermined reference voltage of the voltage comparator circuit, such comparison indicating whether the ground strap coupled between the operator and ground is electrically continuous.

2. A method of protecting circuit elements from electrostatic discharges between an operator and ground in accordance with claim 1, wherein:

coupling a ground strap between the operator and ground comprises coupling a ground strap and a current limiting resistor in series with such ground strap between the operator and ground; and comparing the voltage at the signal input terminal to at least one predetermined reference voltage of the voltage comparator circuit comprises comparing the voltage at the signal input terminal to first and second reference voltages representing upper and lower limit values of a desirable resistance in the coupling of the ground strap and the current limiting resistor between the operator and ground, and verifying that the voltage at said signal input terminal falls within the upper and lower limit values before exposing the circuit elements to the proximity of the operator.

3. A method of protecting circuit elements from electrostatic discharges between an operator and ground in accordance with claim 2, wherein the non-grounded signal input terminal is electrically coupled to a ground-isolated conductive actuator element of a normally deactivated switch coupled between the positive supply voltage and the power input terminal of the voltage comparator circuit, and wherein establishing electrical contact between the operator and the signal input terminal of the voltage comparator circuit comprises:

moving the actuator element of the switch by manual contact of the operator with the actuator element, thereby activating the switch to apply the positive supply voltage to the voltage comparator circuit.

4. A method of protecting circuit elements from electrostatic discharges between the operator and ground in accordance with claim 1, wherein the non-grounded signal input terminal is electrically coupled to a ground-isolated, electrically conductive actuator element of a normally deactivated electrical switch coupled between the positive supply voltage and the power input terminal to the voltage comparator circuit, and wherein establishing electrical contact between the operator and the signal input terminal of the voltage comparator circuit comprises:

moving the actuator element by manual touch of the actuator element by the operator, thereby activating the electrical switch to apply the positive supply voltage to the voltage comparator circuit.

5. A method of protecting circuit elements from electrostatic discharges between an operator and ground in accordance with claim 4, wherein the electrical switch is a toggle switch and the actuator element is a toggle lever which is spring-biased into a toggle position wherein the switch remains normally deactivated, and wherein moving the actuator element by manual touch comprises moving the toggle lever into a switch activating position against a spring bias force of the toggle lever, whereby the hand of the operator establishes a pressure contact with the toggle lever.

6. Apparatus for protecting articles from electrostatic discharges by verifying an electrical continuity of a ground strap connection between an operator and ground comprising:

a voltage comparator circuit including at least one differential amplifier element having a first reference signal port coupled to a reference junction of a first voltage divider circuit between a positive voltage terminal and ground, and having a first test signal port coupled to a non-grounded signal input terminal;

a safety impedance having a first terminal coupled to the positive voltage terminal of the voltage comparator circuit and having a second terminal coupled to the signal input terminal;

means for coupling the operator to the signal input terminal and for applying a positive supply voltage with respect to ground to the positive voltage terminal of the comparator circuit within the time period during which the operator is coupled to the signal input terminal; and means for indicating that an electrical continuity between the operator and ground includes a resistance greater than a predetermined, upper limit value of resistance whenever a voltage appearing at the first test signal port exceeds a voltage at the first reference signal port of said at least one differential amplifier.

7. Apparatus for protecting articles from electrostatic discharges according to claim 6, wherein the voltage comparator circuit comprises first and second differential amplifiers and the first reference signal port and the first test signal port are associated with the first differential amplifier, the second differential amplifier having a second reference signal port coupled to a reference junction of a second voltage divider circuit between the positive voltage terminal and ground, and having a second test signal port coupled to the non-grounded signal input terminal, the apparatus further comprising means for indicating that an electrical continuity between the operator and ground has less than a predetermined minimum impedance whenever a voltage appearing at the second test signal port is less than a voltage at the second reference signal port of the second differential amplifier.

8. Apparatus for protecting articles from electrostatic discharges according to claim 7, wherein a buffer resistor having a resistance of substantially the predetermined upper limit value of resistance, and wherein the total resistance of the first voltage divider circuit is less than that of the buffer resistor by at least one order of magnitude.

9. Apparatus for protecting articles from electrostatic discharges according to claim 7, wherein the means for coupling the operator to the signal input terminal and for applying a positive supply voltage with respect to ground to the positive voltage terminal comprises a normally deactivated electrical switch coupled between the positive supply voltage and the positive voltage terminal, such switch having a ground-isolated electrically conductive actuator element coupled to the non-grounded signal input terminal.

10. Apparatus for protecting articles from electrostatic discharges according to claim 9, wherein the electrical switch is a toggle switch and the actuator element is a toggle lever which is spring biased into a toggle position wherein the switch remains normally deactivated, such that when an operator manually contacts the toggle lever to urge the switch lever into an activating position, the spring bias force of the toggle lever establishes a minimum electrical contact force between the operator and the toggle lever.

* * * * *